United States Patent [19]

Atherton

[11] Patent Number: 5,076,905

[45] Date of Patent: Dec. 31, 1991

[54] ELECTROPHORETIC DEPOSITION APPARATUS

[75] Inventor: Glyn Atherton, Widnes, Great Britain

[73] Assignee: Chloride Silent Power, Ltd., Runcorn, United Kingdom

[21] Appl. No.: 474,139

[22] PCT Filed: Nov. 9, 1988

[86] PCT No.: PCT/GB88/00964

§ 371 Date: Jun. 28, 1990

§ 102(e) Date: Jun. 28, 1990

[87] PCT Pub. No.: WO89/04749

PCT Pub. Date: Jun. 1, 1989

[30] Foreign Application Priority Data

Nov. 13, 1987 [GB] United Kingdom ..... 8726599

[51] Int. Cl.[5] ..... C25D 7/04

[52] U.S. Cl. ..... 204/299 R; 204/180.2; 204/180.9; 204/299 EC; 118/429

[58] Field of Search ..... 204/180.2, 180.9, 299 R, 204/299 EC; 118/429

[56] References Cited

U.S. PATENT DOCUMENTS

| | | | |
|---|---|---|---|
| 4,092,231 | 5/1978 | Chronberg | 204/180.9 |
| 4,246,088 | 1/1981 | Murphy et al. | 204/300 EC |
| 4,376,031 | 3/1983 | Andrus et al. | 204/299 EC |
| 4,436,594 | 3/1984 | Nishida et al. | 204/180.2 |
| 4,791,880 | 12/1988 | Aigo | 118/429 |

FOREIGN PATENT DOCUMENTS

| | | |
|---|---|---|
| 2003183 | 3/1979 | United Kingdom . |
| 2178889A | 7/1986 | United Kingdom . |

OTHER PUBLICATIONS

Proceedings: DOE/EPRI Beta (Sodium-Sulfur) Battery Workshop VI, May 19-23, 1985, Snowbird, Utah.

*Primary Examiner*—John Niebling
*Assistant Examiner*—David G. Ryser
*Attorney, Agent, or Firm*—Finnegan, Henderson Farabow, Garrett & Dunner

[57] ABSTRACT

It has hitherto been difficult to achieve the even deposition of a cup-shaped body from slurry flowing around a mandrel. This specification discloses a deposition apparatus including control means providing a substantially uniform slurry flow rate over all surfaces of the mandrel to give uniform deposition.

5 Claims, 1 Drawing Sheet

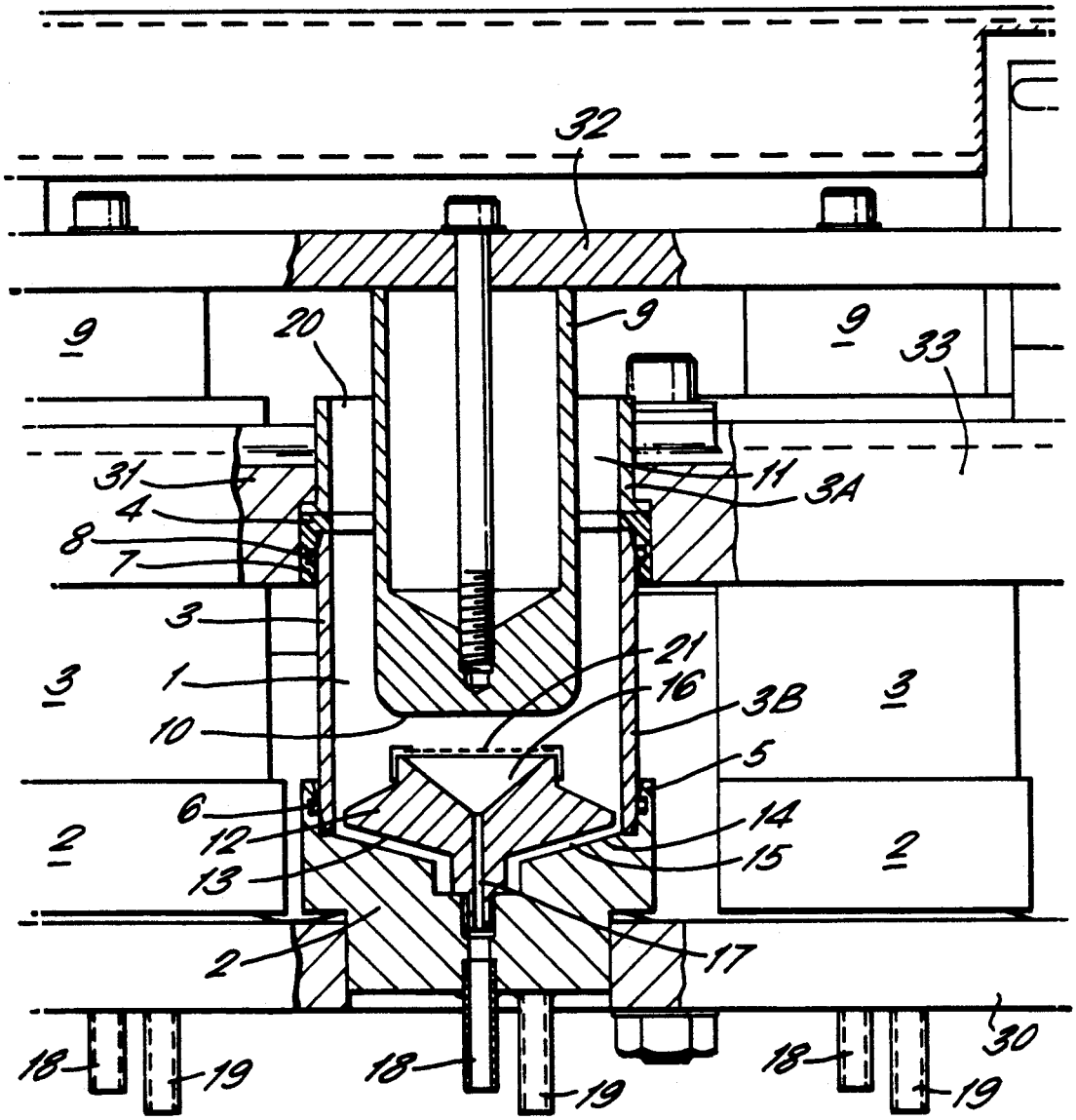
32
9
20
9
9
33
31
11
3A
4
8
7
3
3
1
21
16
3B
3
10
5
6
14
2
12
15
2
13
2
17
30
18
19
18
19
18
19

ELECTROPHORETIC DEPOSITION APPARATUS

FIELD OF THE INVENTION

This invention relates to deposition apparatus, and particularly to apparatus for use in the deposition of a cup-shaped body from a slurry.

DESCRIPTION OF THE PRIOR ART

It is sometimes necessary to produce by deposition, for example electrophoretic deposition, a cup-shaped body, that is a tubular body having a closed end, and a difficulty which arises is in achieving a substantially uniform deposition in order to produce a body in which the tubular wall and the end wall are of substantially the same even thickness.

Such cup-shaped bodies are used as membranes in sodium-sulphur electrochemical cells, where a cup-shaped body of beta alumina material is used as a solid electrolyte separating the liquid sodium and sulphur materials. Such a cell is described in GB-A-2178889.

For deposition a mandrel is placed in a slurry comprising the material to be deposited suspended in a carrier liquid. If the necessary deposition is to take a realtively long time, for example more than 1 minute, then it is necessary for the slurry to be agitated, for example by the use of magnetic stirrers, in order to prevent the material to be deposited settling out of suspension. However, such agitation can result in deposited material being removed from the mandrel, and thus it is preferable to use an apparatus in which the slurry is pumped around a closed circuit containing a deposition chamber in which the mandrel is located.

STATEMENT OF THE INVENTION

According to this invention there is provided an apparatus for use in the deposition of a cup-shaped body from a slurry, comprising a chamber having a slurry inlet and a slurry outlet, and a mandrel mounted in the chamber, on the outer surface of which mandrel the cup-shaped body is deposited as slurry flows from the inlet to the outlet, including control means to provide a substantially uniform slurry flow rate over all surfaces of the mandrel on which deposition is to take place.

Preferably when the apparatus is used for electrophoretic deposition the control means also serves to provide a substantially uniform electric field over surfaces of the mandrel on which deposition is to take place.

The chamber can have a slurry inlet at a lower end, a first slurry outlet at an upper end, and a second slurry outlet at the lower end, the mandrel being mounted in the chamber to define a space between the outer surface of the mandrel and the inner surface of the chamber, the first outlet surrounding the mandrel and the second outlet being below a bottom face of the mandrel and having a mouth extending over substantially the whole area of the bottom face of the mandrel.

With such apparatus the flow of slurry from the inlet to the first outlet serves for deposition of the side wall of the cup-shaped body on the mandrel, while the flow of slurry from the inlet to the second outlet serves for deposition of the end wall of the cup-shaped body on the bottom face of the mandrel. During such deposition the control member serves to provide a substantially uniform flow over the whole of the bottom face of the mandrel whereby a substantially uniform thickness end wall for the cup-shaped body is deposited.

Preferably the apparatus includes a slurry flow controlling member mounted at the lower end of the chamber and having the second outlet therein, the flow controlling member having a conical downwardly facing outer surface facing a corresponding surface of the chamber to provide an annular space constituting the slurry inlet to the chamber.

With such apparatus it is ensured that slurry entering the chamber does so in a manner giving satisfactory flow over the mandrel.

Preferably the chamber comprises a base member having the inlet and the second outlet therein, and a tubular wall member mounted on the base member.

The apparatus is particularly useful for carrying out electrophoretic deposition, in which case the chamber can constitute one electrode and the mandrel constitute the other electrode for the electrophoretic deposition process.

With such an apparatus the control means also serves to provide a substantially uniform electric field over all surfaces of the mandrel on which deposition is to take place.

With such an apparatus the chamber wall member can be formed of electrically isolated upper and lower portions whereby different thicknesses of deposition can be obtained on the mandrel opposite the upper and lower portions of the chamber wall by suitable control of the electric fields produced by the upper and lower portions. Thus, a cup-shaped body can be obtained having a thickened wall portion at its open end, such thickened wall portion being more easily worked as may be necessary for subsequent use of the cup-shaped member.

The control member can be a mesh member.

A plurality of apparatuses according to this invention can be arranged with their outlets discharging into a common receptacle whereby the slurry discharged from the apparatus can be easily collected for processing for reuse.

With such an arrangement used for electrophoretic deposition the chamber walls, or corresponding positions thereof, of the apparatus can be electrically commoned, and the mandrels of the apparatus can be electrically commoned.

With such an arrangement the electrical supply to the apparatus is simplified.

BRIEF DESCRIPTION OF THE DRAWINGS

This invention will now be described by way of example with reference to the drawing which is a partly sectioned side elevational view of an arrangement of an apparatus according to this invention.

DETAILED DESCRIPTION

The arrangement to be described comprises a plurality of apparatuses arranged in line, and each serving for the production of a cup-shaped body, and in particular a cup-shaped beta alumina body for use in a sodium-sulphur electrochemical cell, by electrophoretic deposition from a slurry.

Each apparatus comprises a chamber 1 formed of a base member 2 and a cylindrical side wall member 3, both of metal. The side wall member 3 is formed of upper and lower portions 3A and 3B which are electrically isolated by an interposed annular insulating member 4. One end of the lower wall portion 3B is received in an upstanding flange 5 on the base member 2 with a sealing member 6 interposed, while the other end of the lower wall portion 3B is received in a downwardly directed flange 7 on the insulating member 4, again with an interposed sealing member 8. The upper wall portion 3A is secured to the insulating member 4.

Projecting downwardly into the chamber 1 through the open top thereof is a cylindrical metal mandrel 9 having a bottom face 10 directed towards the bottom of the chamber 1, there being an annular space 11 between the mandrel 9 and the chamber wall 3.

The base member 2 of the chamber 1 is formed with a conical depression in which is mounted a flow controlling member 12 which has a conical downwardly facing outer surface 13 facing a conical surface 14 of the base member 2 to provide a conical annular space 15 therebetween.

The flow controlling member 12 has a conical depression 16 in its upper surface, the depression having a mouth extending over substantially the whole area of the bottom face 10 of the mandrel 9. The depression 16 is connected by a passageway 17 in the base member 2 to a pipe 18 extending out of the base member 2. A further pipe 19 is connected by way of a passageway (not shown) in the base member 2 to the space 15 between the base member 2 and the flow control member 12.

In use of the apparatus a slurry is pumped into the chamber 1 through the pipe 19 which serves as an inlet therefor, which slurry flows through the space 15 and up the space 11 between the mandrel 9 and the chamber wall 3 to flow out of the chamber 1 over the top of the chamber wall 3 through the space 20 between the chamber wall 3 and the mandrel, which space 20 constitutes a first outlet from the chamber 1.

Some slurry flows from the space 15 between the bottom surface 10 of the mandrel 9 and the flow controlling member 12 and into the depression 16, to flow out of the chamber 1 through the passage 17 and the pipe 18 which constitutes a second outlet from the chamber 1. In order to ensure substantially uniform flow of slurry over the bottom face 10 of the mandrel 9, a metal mesh member 21 is secured over the mouth of the depression 16 in the flow controlling member 12.

During such slurry flow the upper and lower portions 3A and 3B of the chamber wall 3, and the mandrel 9 are held at appropriate electrical potentials such that electrophoretic deposition occurs and material from the slurry is deposited onto the surface of the mandrel 9 whereby a cup-shaped body is formed thereon. During such operation the mesh member 21 also serves to ensure that there is a substantially uniform electric field over the bottom surface 10 of the mandrel 9, and this together with the substantially uniform slurry flow rate ensures a substantially uniform thickness deposition on the bottom surface 10 of the mandrel 9.

The portions 3A and 3B of the chamber wall 3 can be maintained at their appropriate potential for differing times whereby different thickness deposition is effected on the mandrel 9, that is a thicker deposit opposite the portion maintained at the appropriate potential for the longer time. The cup-shaped body produced can thus be given a relatively thick wall portion, for example on upper free end portion, for subsequent machining as necessary.

For the production of beta alumina bodies for use as a solid electrolyte for a sodium-sulphur cell, the slurry supplied to the apparatus would comprise a suspension of beta alumina in amyl alcohol.

As shown in the drawing, a plurality of apparatuses each as described above can be arranged in a line with their base members 2 electrically and mechanically interconnected by a first plate member 30, their upper wall portions 3A electrically and mechanically interconnected by a second plate member 31, and their mandrels 9 electrically and mechanically interconnected by a third plate member 32, the first outlets 20 of the chambers 1 all overflowing into a common receptacle 33. Slurry from the second outlets 18 of the chambers 1 can be added to that collected in the common receptacle 33 and sent for processing for reuse.

I claim:

1. An apparatus for use in the electrophorectic deposition of a cup-shaped body from a slurry, comprising:

a chamber constituting a first electrode and having a slurry inlet disposed at a lower end of said chamber, a first slurry outlet disposed at an upper end of said chamber and a second slurry outlet disposed at said lower end of said chamber;

a mandrel constituting a second electrode and having an outer surface and being mounted in said chamber to define a space between said outer surface of said mandrel and an inner surface of said chamber, said first slurry outlet being disposed at an upper end of said space and surrounding said mandrel, and said second slurry outlet being disposed below a bottom face of said mandrel and having a mouth extending over substantially the whole area of said bottom face of said mandrel; and mesh member mounted over said mouth of said second outlet for controlling a flow of slurry from said slurry inlet to said first and second slurry outlets to achieve a substantially uniform slurry flow rate over all surfaces of said mandrel on which said cup-shaped body is to be deposited.

2. The apparatus as claimed in claim 1, further comprising a slurry flow controlling member mounted at said lower end of said chamber and having said second outlet therein, said slurry flow controlling member having a conical outer surface, an upper end of said conical outer surface having a diameter larger than that of a lower end of the said conical outer surface, and said lower end of said chamber having a conical inner surface, said conical outer surface of said slurry flow controlling member and said conical inner surface of said lower end of said chamber defining an annular space constituting said slurry inlet.

3. The apparatus as claimed in claim 1, in which said chamber includes a base member having passageways from said slurry inlet and said second slurry outlet therein, and a tubular wall member mounted on said base member.

4. The apparatus as claimed in claim 3, in which said chamber wall member includes electrically isolated upper and lower portions.

5. The apparatus as claimed in claim 1 wherein said mesh member comprises a portion of said first electrode constituted by said chamber.

* * * * *